US005934036A

United States Patent [19]

Gallagher, Jr.

[11] Patent Number: 5,934,036

[45] Date of Patent: Aug. 10, 1999

[54] INSULATED CONCRETE SLAB ASSEMBLY

[76] Inventor: Daniel P. Gallagher, Jr., 7662 Estate Co., Niwot, Colo. 80503

[21] Appl. No.: 08/740,696

[22] Filed: Nov. 1, 1996

[51] Int. Cl.[6] ..... E04B 5/32

[52] U.S. Cl. ..... 52/323; 52/250; 52/294; 52/319; 52/320; 52/742.14; 52/745.13; 249/188; 405/229

[58] Field of Search ..... 52/169.9, 169.11, 52/294, 299, 250, 742.14, 745.13, 167.4, 319, 320, 323; 405/229; 249/188, 203

[56] References Cited

U.S. PATENT DOCUMENTS

| | | | |
|---|---|---|---|
| 2,089,893 | 8/1937 | Greulich . | |
| 2,228,763 | 1/1941 | Henderson | 52/294 |
| 2,534,580 | 12/1950 | Edwards . | |
| 2,602,323 | 7/1952 | Leemhuis . | |
| 2,743,602 | 5/1956 | Dunn . | |
| 2,772,468 | 12/1956 | Heltzel . | |
| 2,852,932 | 9/1958 | Cable . | |
| 2,881,501 | 4/1959 | Raney . | |
| 3,000,144 | 9/1961 | Kitson . | |
| 3,207,465 | 9/1965 | Papin . | |
| 3,218,767 | 11/1965 | Stark . | |
| 3,358,960 | 12/1967 | Oliver et al. . | |
| 3,479,779 | 11/1969 | Ziegler . | |
| 3,501,878 | 3/1970 | Segal . | |
| 3,624,978 | 12/1971 | Skinner . | |
| 3,673,750 | 7/1972 | Bokvist et al. . | |
| 3,757,481 | 9/1973 | Skinner . | |

(List continued on next page.)

FOREIGN PATENT DOCUMENTS

| | | |
|---|---|---|
| 3444728 A1 | 6/1986 | Germany . |
| 3546032 A1 | 6/1987 | Germany . |
| 121299 | of 1971 | Norway . |

OTHER PUBLICATIONS

Encyclopedia of Polymer Science and Engineering, vol. 6, Jacqueline I. Kroschwitz (ed.), John Wiley and Sons, Inc., (1990) pp. 52–73.

Zarling, J.P. and Braley, W.A. (1984), "Heat Loss Factors for Building Foundation Insulation Systems," Proc. Colo. Reg. Eng. Specialty Conf., Apr. 4–6, 1984, Canadian Soc. for Civil Engineering, Montreal, Quebec, pp. 909–927.

Borg, R. and Carter, C. (1988), "Legalett, A Low–Energy Building System With Foundation Heat Storage," Energy Solutions for Today 14th Ann. Conf. of the Solar Energy Soc. of Canada Inc. Proceedings, The Solar Energy Soc. of Canada, Inc., Ottawa, Ontario, Canada, Jun. 22–25, 1988, pp. 252–254.

MFG (Molded Fiber Glass Concrete Forms Company, Union City, PA,) specification sheet.

Falcon Manufacturing Co., Inc., 1895 W. Dartmouth Ave., Englewood, CO 80110, specification sheet for Slab Void.

Thermal Form, Inc. 701 E. 4th Street, Perric, CA 92370, specification sheet.

Geremia, M. et al. (1989), "PFRA Experience with Foundations and Underslab Drainage for Concrete Chutes," Proc. of Dam Safety Seminar, Canadian Dam Safety Assoc., Edmonton, Alberta, Held Sep. 1989, Edmonton, Canada, BiTech Publishers Ltd., Vancouver, B.C., pp. 303–344.

*Primary Examiner*—Christopher Kent
*Attorney, Agent, or Firm*—Greenlee, Winner and Sullivan, PC

[57] ABSTRACT

An insulated concrete slab assembly for use over expansive soils. A slab is cast in place by pouring concrete into preshaped insulating forms. The forms remain permanently in place and provide insulation to reduce heat transfer through the slab. The shape of the forms provides strengthening ribs on the slab. The ribs act as beams which allow the slab to bridge or cantilever over expansive soil between foundation walls. The forms are supported during construction by support members or legs which later prevent damage to the slab by eliminating or limiting the forces which can be applied to the slab by expanding soil.

40 Claims, 11 Drawing Sheets

U.S. PATENT DOCUMENTS

| | | | |
|---|---|---|---|
| 3,956,859 | 5/1976 | Ingestrom . | |
| 4,117,071 | 9/1978 | Hannah | 52/294 X |
| 4,202,145 | 5/1980 | Coulter et al. . | |
| 4,335,548 | 6/1982 | Rehbein | 52/169.11 |
| 4,413,456 | 11/1983 | Gilb . | |
| 4,524,553 | 6/1985 | Hacker . | |
| 4,685,267 | 8/1987 | Workman . | |
| 4,689,926 | 9/1987 | McDonald . | |
| 4,702,048 | 10/1987 | Millman . | |
| 4,711,058 | 12/1987 | Patton . | |
| 4,739,598 | 4/1988 | Jensen et al. . | |
| 4,745,716 | 5/1988 | Kuypers . | |
| 4,799,348 | 1/1989 | Brami et al. . | |
| 4,869,032 | 9/1989 | Geske . | |
| 4,916,879 | 4/1990 | Boeshart . | |
| 4,938,449 | 7/1990 | Boeshart . | |
| 4,940,360 | 7/1990 | Weholt . | |
| 5,067,298 | 11/1991 | Petersen . | |
| 5,085,539 | 2/1992 | Massarsch . | |
| 5,174,083 | 12/1992 | Mussell . | |
| 5,224,321 | 7/1993 | Fearn . | |
| 5,352,064 | 10/1994 | Carruthers et al. . | |
| 5,426,896 | 6/1995 | Sloma | 52/2.11 X |
| 5,526,623 | 6/1996 | Bullivant | 52/294 X |
| 5,540,524 | 7/1996 | Gonsalves | 52/294 X |

INSULATED CONCRETE SLAB ASSEMBLY

This invention relates generally to static structures and earth engineering and more specifically to an insulated concrete slab assembly for accommodating expansive soil and for providing thermal isolation from the soil.

BACKGROUND OF THE INVENTION

Commercial and residential buildings are often built on foundations comprising vertical perimeter walls of poured concrete. Since the vertical foundation walls are structural members which support the building, they are usually several feet in depth and function as beams bridging between footers or piers resting on bedrock or stable soil. It is common practice in such buildings to provide a basement, or ground floor, wherein at least a portion of the basement walls include the vertical foundation walls and wherein the basement floor is a poured concrete slab resting on the soil enclosed by the foundation walls. Typically, the foundation is constructed by first excavating a pit for the basement and digging trenches around the periphery of the pit for the foundation footers. Then forms are erected around the periphery of the pit and concrete for the foundation walls is poured into the forms. Depending on the load-supporting requirements of the foundation and the supporting soil, it is usually necessary to provide footers or piers of some type under the foundation walls.

A major problem with conventional construction in certain soil and climate conditions is that the location of the basement floor can be unstable due to movement of the underlying soil. This problem can be especially severe when the floor is simply a slab of concrete poured onto the surface of the soil which forms the floor of the excavation pit. For example, certain dense clay soils, such as bentonite, tend to dry out after excavation and then later absorb water and swell. This swelling causes the slab to move relative to the foundation walls and can generate large forces which are sufficient to crack or break the slab. In general, because the foundation walls must support the building, they are supported by solid ground or bedrock and therefore are very stable. However, when the basement floor is a relatively thin slab of concrete having a large surface area and resting on a large area of soil, it is highly vulnerable to movement due to expansion and contraction of the soil as water is absorbed and released by the soil. The relative motion between the slab and the walls can damage interior walls and therefore precludes the supporting of interior walls on the slab.

A second problem associated with a conventional poured concrete slab is the loss of heat through the slab. Since concrete is a poor thermal insulator, heat can be readily transferred through the slab and into the soil below when the slab is resting on the soil. This heat transfer can result in higher fuel consumption and heating costs for the building as well as a loss of thermal comfort due to radiant heat loss to the cold slab.

A variety of inventions have been made in the art of concrete slabs. For example, U.S. Pat. Nos. 2,881,501 and 3,358,960 disclose fiberboard forms for creating voids to reduce the weight of concrete slabs. U.S. Pat. No. 4,685,267 discloses a fiberboard box for creating a void in and under a concrete formation. U.S. Pat. No. 4,702,048 discloses a form, for cast in situ concrete slabs, comprising a sheet of material formed into a planar base with an array of upwardly convex hemispherical protrusions for creating voids in the concrete. U.S. Pat. No. 4,799,348 discloses a process for constructing pin point foundations and for using both recoverable and non-recoverable forms to produce a rigid ribbed slab resting on the pin point foundations. U.S. Pat. No. 5,224,321 discloses a method of installing prefabricated floor panels on temporary supports while pouring permanent concrete supports. U.S. Pat. No. 5,352,064 discloses a foundation having a moisture resistant spacer resting on expansive soil and supporting a flat surface on which a concrete slab can be poured. The spacer is designed to permanently deform if the soil expands after the concrete has hardened thereby preventing damage to the slab. This requires that the spacer be carefully designed to be strong enough to carry the weight of the slab during construction and weak enough to subsequently permanently deform or collapse under the force of expanding soil without damage to the slab.

Other inventions have attempted to solve only the heat transfer problem. U.S. Pat. Nos. 3,673,750 and 3,956,859 disclose concrete slabs poured on insulating material resting on the soil. U.S. Pat. No. 5,174,083 discloses a system for casting a floating slab with perimeter insulation.

Although each of the previously listed inventions has attempted to solve either the problem of slab movement due to soil expansion or the problem of heat loss through a slab, they have not provided a single solution to both of these problems. The present invention provides a lightweight rigid slab assembly which can be used over expansive soils without movement or damage, to itself or to interior walls resting on the slab, and which also provides thermal insulation to substantially reduce heat loss through the slab.

SUMMARY OF THE INVENTION

This invention provides methods and apparatus for eliminating slab damage and minimizing slab movement due to soil expansion and for reducing heat loss through a slab.

The invention is a slab assembly cast in place by pouring concrete into thermally insulating preshaped forms made from a material such as foamed polymer. The shape of the forms provides for casting strengthening ribs into the slab. The forms may be supported by support members, resting on the soil, which support workmen and wet concrete during construction but which subsequently limit the force which can be applied to the slab by expanding soil. After the concrete has hardened, the ribs act as structural beams which allow the slab, or a portion thereof, to carry its load without resting on the soil. In one embodiment, the support members can be made of a degradable material which disintegrates over time when exposed to moisture thereby leaving the slab unsupported by the soil. In other embodiments, the forms include, as support members, resilient rails, or rails having degradable pads, resting on the soil. In these cases the rails may be arranged in rows or in a grid pattern providing at least partial support for the slab after construction. The rails permit the soil to expand without damage to the slab. In all cases, after the slab is cast, the forms remain in place and function as thermal insulation for reducing heat loss through the slab and into the underlying soil. The hardened slab can be supported entirely by the foundation walls (and intermediate grade beams between the walls if necessary) or by a grid of compliant support members resting on the soil. When supported by the foundation walls, the slab can be suspended with sufficient clearance from the soil to prevent contact even with maximum expansion. Also, the slab be can anchored or keyed into the foundation walls to provide lateral support for the foundation walls against lateral forces generated by the surrounding soil.

DESCRIPTION OF THE PREFERRED EMBODIMENT

Figure 1:
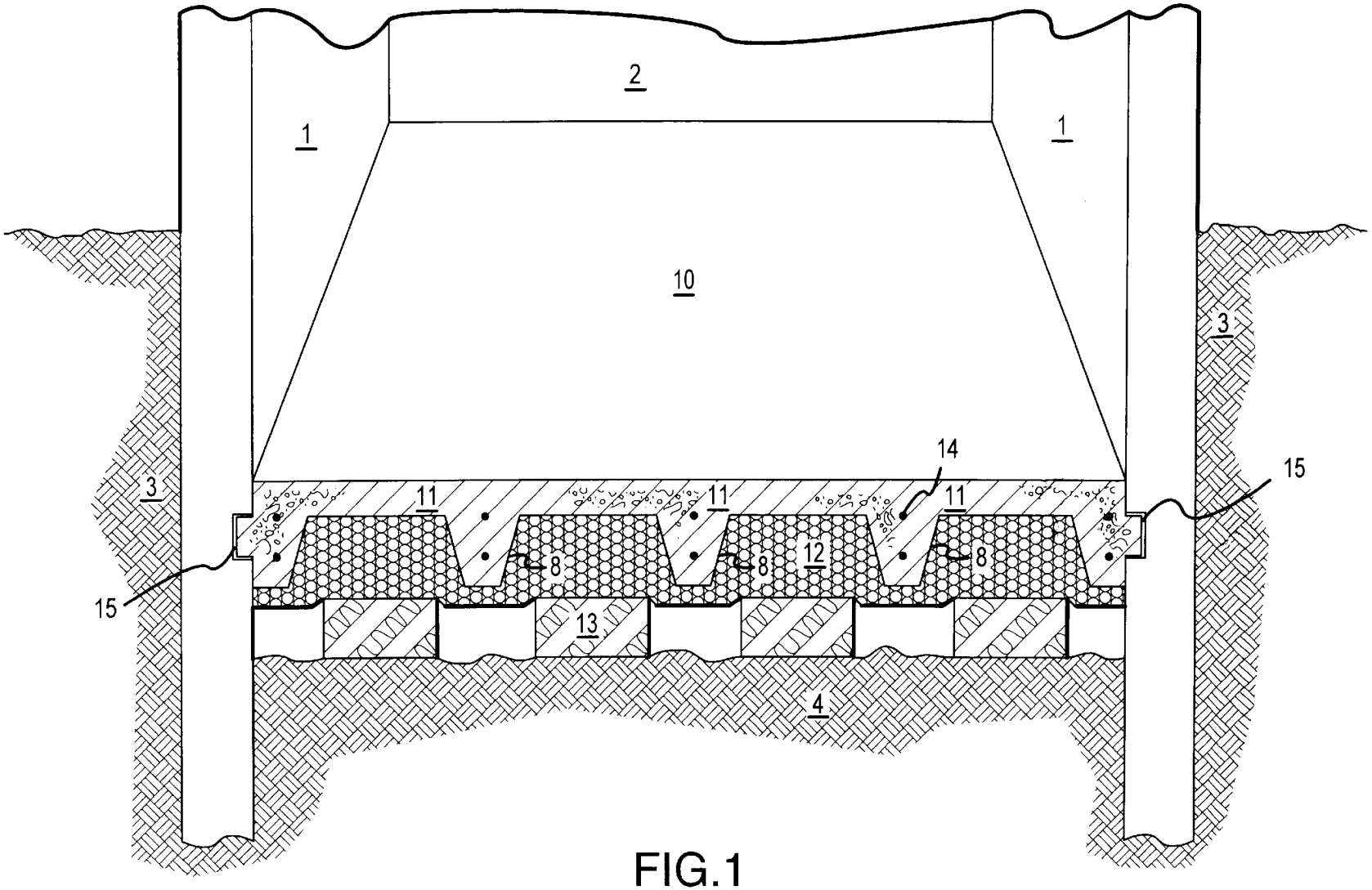
FIG. 1 shows a perspective view of a slab assembly within a foundation.

In the drawings, like reference numerals indicate like features; and, a reference numeral appearing in more than one figure refers to the same element. The drawings and the following detailed descriptions show specific embodiments of the invention. Numerous specific details including materials, dimensions, and products are provided to enable a more thorough understanding of the invention. However, it will be obvious to one skilled in the art that the present invention may be practiced without these specific details.

FIG. 1 is a schematic drawing showing a perspective view of a first embodiment of the invention. The invention utilizes a conventional foundation having side walls 1 and end walls 2 constructed in an excavation made in soil 3. First embodiment support members 13 rest on excavation floor 4 and provide support for first embodiment insulating forms 12. Depressions 8 in forms 12 provide space for forming first embodiment reinforcing ribs 11 on first embodiment poured concrete slab 10. First embodiment reinforcing steel bars 14 are imbedded in the upper and lower portions of ribs 11. Slab 10 is keyed for support into walls 1 at keyways 15 and similarly into walls 2 (not shown).

Figure 2:
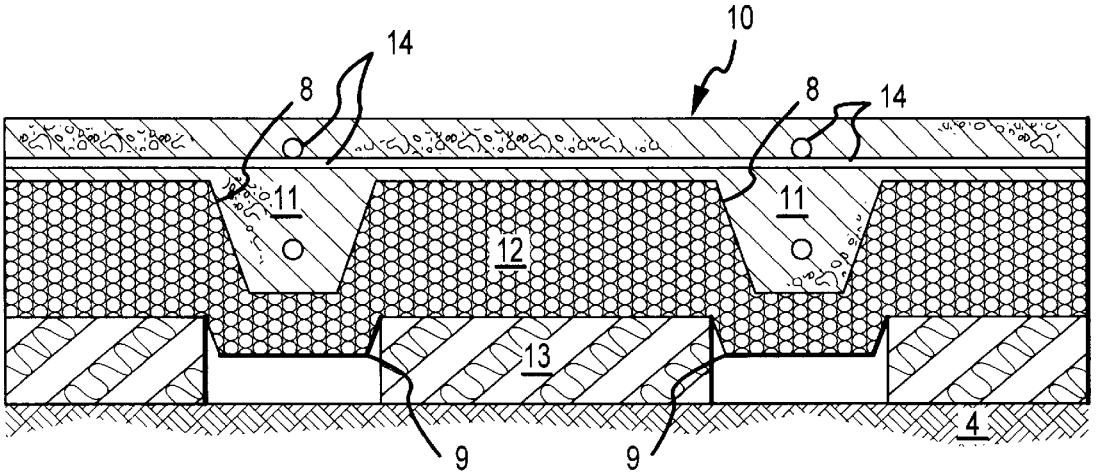
FIG. 2 shows a cross sectional view of a first embodiment of the slab assembly.

FIG. 2 shows a cross sectional view of the first embodiment in more detail. Insulating form 12 is made of a foamed polymer, preferably expanded polystyrene, commonly referred to as EPS, and has depressions 8 which are shaped to produce reinforcing ribs 11 on slab 10 when concrete is poured into the form. Ribs 11, along with imbedded steel bars 14, provide a moment of inertia sufficient for slab 10 to bridge across excavation floor 4. Support members 13 provide temporary support for forms 12 during construction but are designed to disintegrate or deform under the pressure of expanding soil after slab 10 hardens. Support members 13 must be tall enough to provide separation between slab 10 and excavation floor 4 adequate to prevent movement of, or damage to, slab 10 when the soil expands. Support members 13 preferably are made of a degradable material which disintegrates when exposed to moisture over time, such as corrugated paper or other fibrous material, biodegradable plastics or other material known to the art. However, they can also be made of foamed polymers which deform temporarily or permanently under the pressure of expanding soil. Typically, forms 12 are made in 4 foot by 8 foot sheets with a thickness of 6 inches between slab 10 and support 13. However, the thickness depends on the load carrying requirements of slab 10. Support members 13 are typically 8 inches long by 15 inches wide and up to 12 inches thick, depending on the anticipated swell of the soil which may be as much as 8 to 10 inches. The support members 13 are placed in channels 9 of forms 12 between ribs 11 on approximately two foot centers along the length of forms 12. The details of the size and configuration of slab 10 depend on the structural requirements of the slab and foundation. These requirements may include slab loading, length of span, building codes, etc. For example, a typical residential slab may be 3 inches thick with ribs 8 inches wide, 5 inches deep and spaced 24 inches apart.

Figure 3:
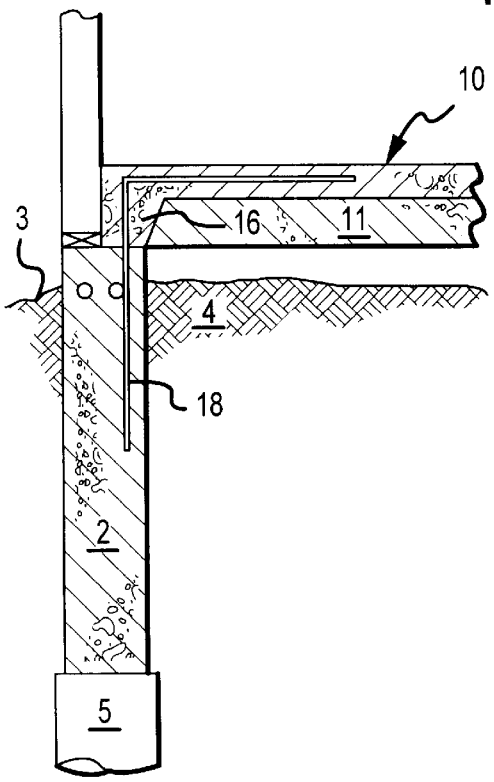
FIG. 3 shows the first embodiment supported on a foundation wall.
Figure 4:
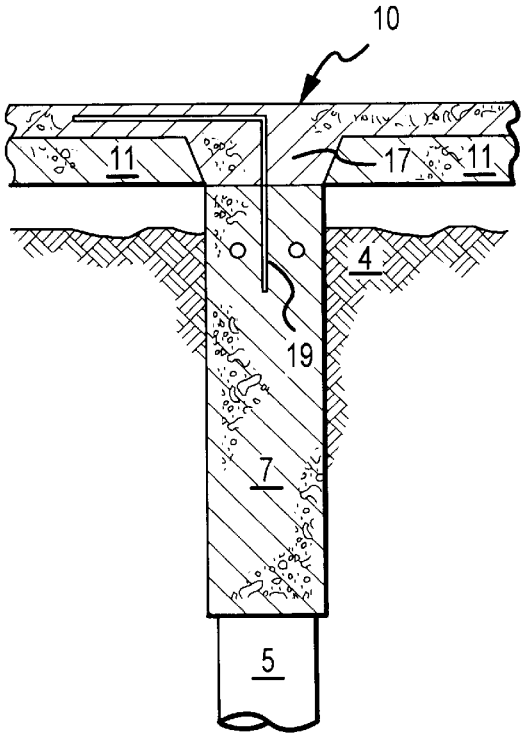
FIG. 4 shows the first embodiment supported at an intermediate point by a grade beam.
Figure 5:
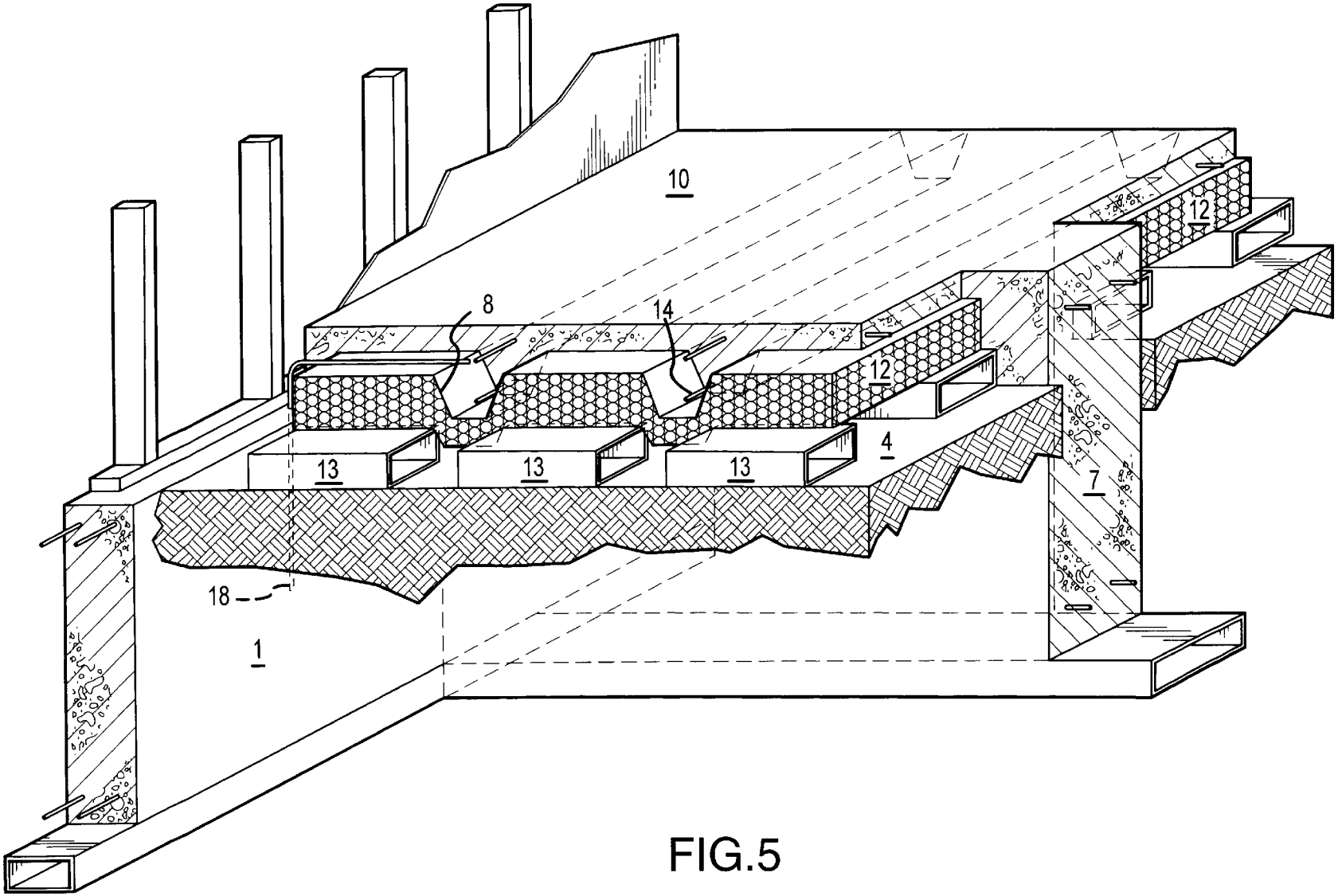
FIG. 5 shows a more detailed perspective view of the first embodiment.

Slab 10 can be supported on foundation end wall 2 above grade as shown in FIG. 3. In this figure, slab 10 is shown with ribs 11 perpendicular to the direction shown in FIGS. 1 and 2. For simplicity, forms 12 and support members 13 are not shown. When forms 12 are set in place, a small portion of the foundation end of each form is cut away to form an edge rib 16 which is perpendicular to ribs 11 and which rests on foundation wall 2 when slab 10 is poured. Slab 10 is anchored to wall 2 by edge anchor bars 18 cast in slab 10 and wall 2. Although only shown keyed to wall 2, slab 10 can be keyed into both side walls 1 and end walls 2 of the foundation. FIG. 4 shows a similar arrangement wherein slab 10 is supported at an intermediate point between the foundation walls by grade beam 7. Forms 12 (not shown) are cut away on each side of grade beam 7 to provide an intermediate rib 17 perpendicular to ribs 11 and parallel to grade beam 7. Slab 10 is anchored to grade beam 7 by steel intermediate anchor bars 19 cast in slab 10 and grade beam 7. Grade beams are used when the distance between foundation walls is too great for slab 10 to span. The need for grade beams is determined by the foundation and slab structural requirements and is a function of slab loading, rib dimensions and spacing, size and placement of reinforcing steel, and other variables. Typically, the maximum span is about 20 times the maximum thickness of the slab (i.e., thickness of the slab including rib). In FIGS. 3 and 4, wall 2 and grade beam 7 are shown resting on piers 5. FIG. 5 provides a more detailed perspective view of the first embodiment.

Figure 6:
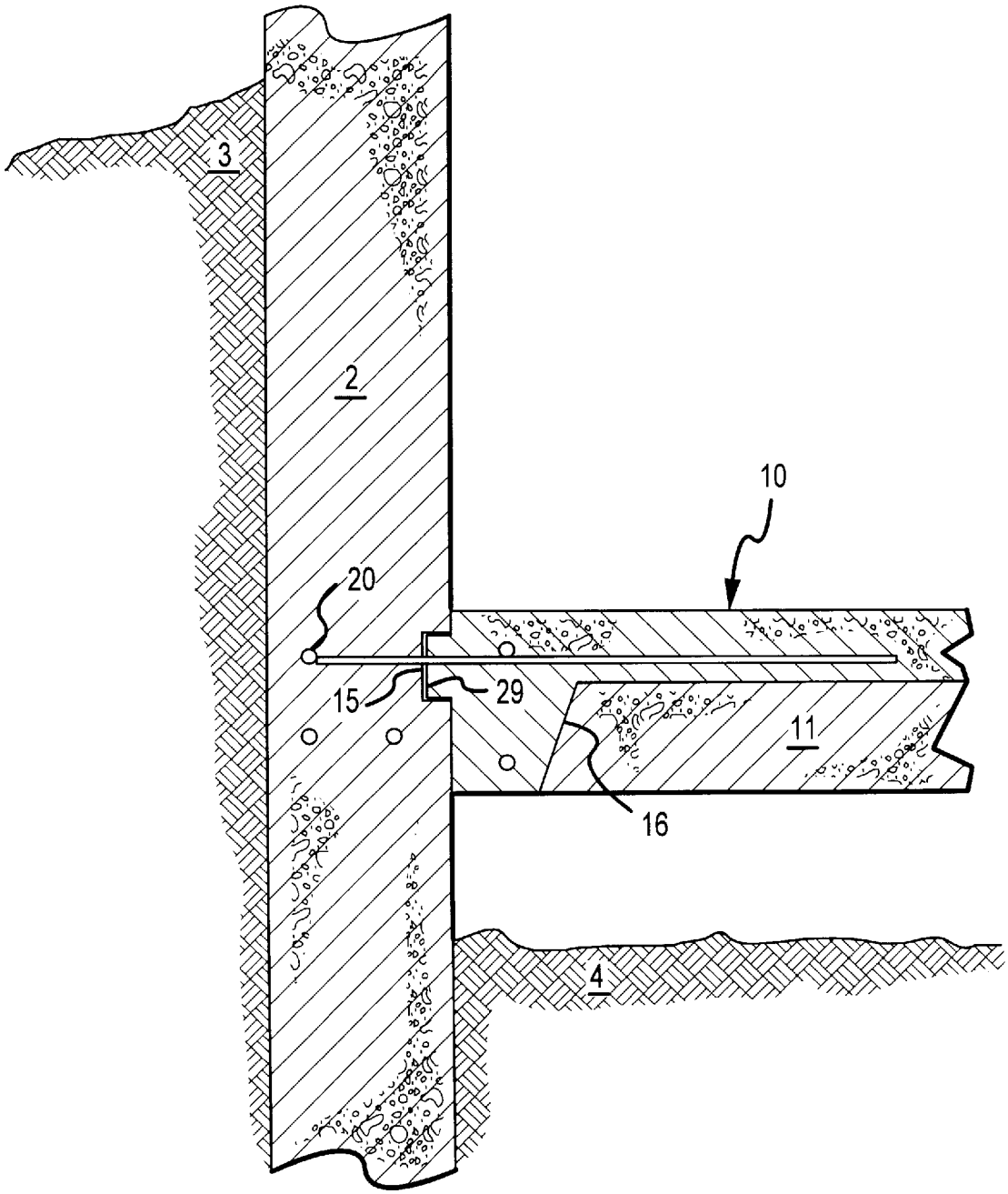
FIG. 6 shows the first embodiment supported by keying into the foundation walls.

Slab 10 can also be supported by keying into a foundation wall with a tongue and groove arrangement as shown in FIG. 6. In this case, a form having a cross section similar in shape to the letter "C" (not shown) is attached to the inside of the foundation wall forms before the walls are poured. When the foundation wall forms are removed after the walls have hardened, foundation wall 2 is left with an indented keyway or groove 15 produced by the "C" section form. Then, when slab 10 is poured, concrete flows into keyway (groove) 15 thereby creating a key (tongue) 29 on slab 10 which keys slab 10 into wall 2. Slab 10 and wall 2 are further anchored together by steel keyway bars 20 cast into wall 2 and slab 10. A convenient "C" section form for the keyway is the steel stud commonly used in commercial buildings. The use of the stud provides a simple way of casting one end of bar 20 into wall 2 while keeping the opposite end free within the stud for later casting into slab 10. This keyed construction provides especially strong lateral support for the foundation walls.

Figure 7:
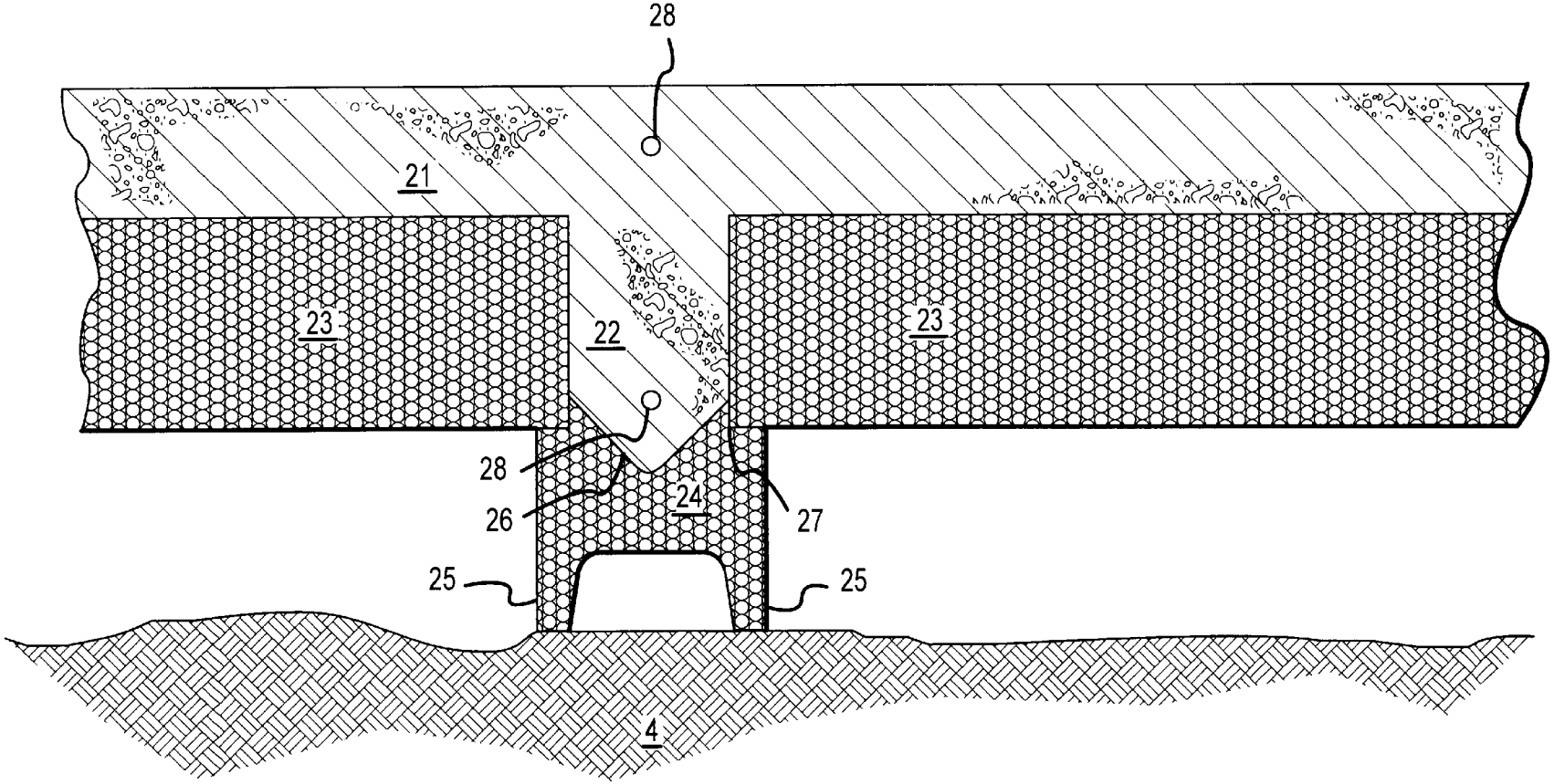
FIG. 7 shows a cross sectional view of a second embodiment of the slab assembly.
Figure 12:
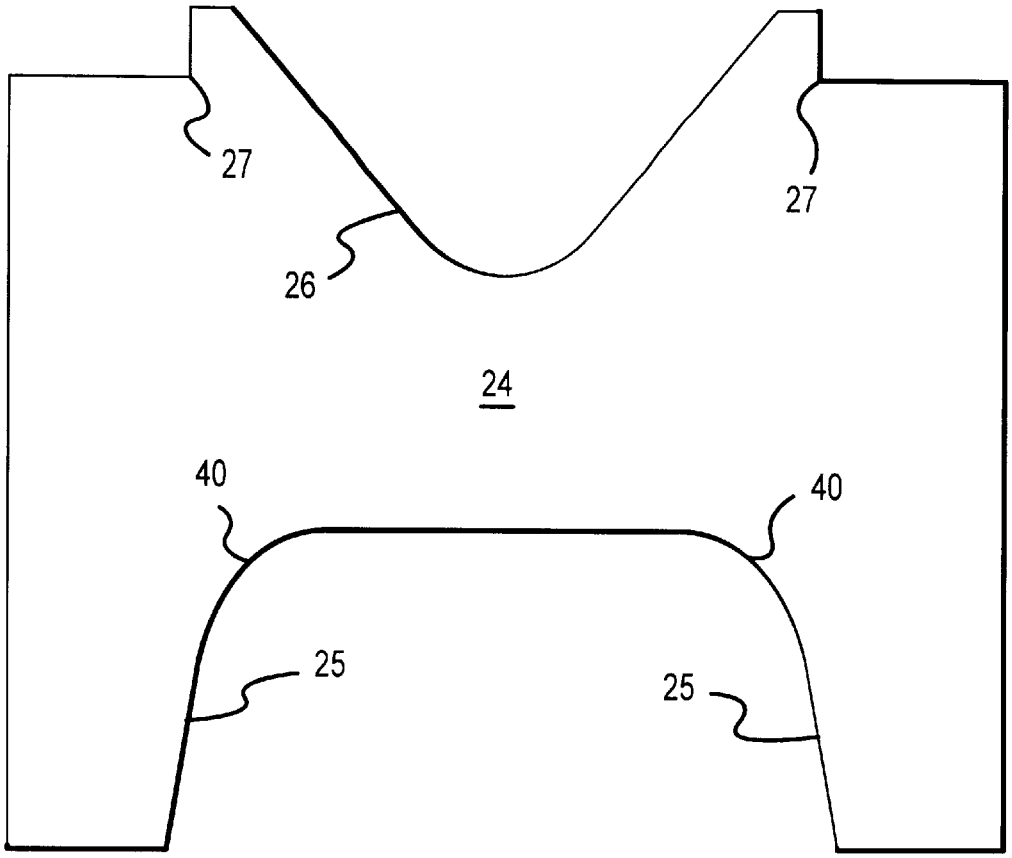
FIG. 12 shows a cross-sectional view of a rail used in the second embodiment.
Figure 14:
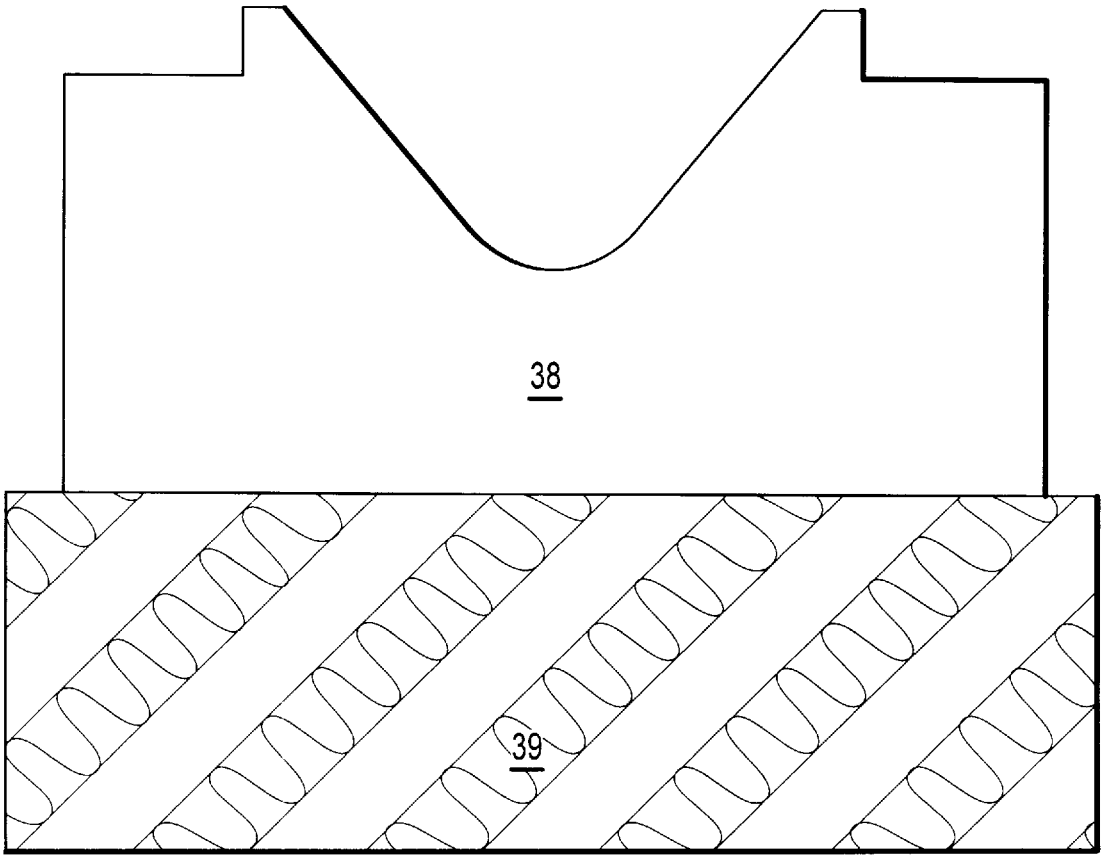
FIG. 14 shows a cross-sectional view of a truncated rail having a degradable pad for support.

FIG. 7 shows a cross sectional view of a second embodiment of the invention. In this embodiment, the slab assembly includes second embodiment slab 21 and insulating forms comprising second embodiment panels 23 and preformed second embodiment rails 24. Simple rectangular panels 23, preferably made of foamed polymer such as EPS, are supported by rails 24 which rest on excavation floor 4. Rails 24 have linear indentations 27 for controlling placement and alignment of panels 23. Rails 24 also include compliant legs 25, for supporting slab 21 during construction, and a valley 26 between indentations 27. When slab 21 is poured, concrete flows into the separation between panels 23, provided by indentations 27, and thereby forms second embodiment reinforcing ribs 22. Second embodiment steel reinforcing bars 28 are cast into both the upper and lower portions of ribs 22 when slab 21 is poured to prevent the breaking of slab 21 due to either up or down loads. The valley 26 produces a triangular cross section on the bottom edge on rib 22. Rails 24 are preferably made of foamed polymer (EPS) which can support slab 21 during construction and which can temporarily or permanently deform under the pressure of expanding soil without damage to slab 21 after the slab has hardened. However, under extreme conditions where the soil expands sufficiently, the triangular edge of rib 22 can be designed to split or collapse rail 24 before forces sufficient to damage slab 21 are generated. FIG. 12 shows the cross section of rail 24 in greater detail. Legs 25 have tapered cross sections which blend into the body of rail 24 with relatively large radii 40. The specific shapes and dimensions of rail 24 can be chosen to permit maximum possible compliance with expanding soil before permanent deformation of rail 24 occurs. These values can be determined by those skilled in the art using the load requirements of slab 21 and the amount of anticipated soil expansion, along with the properties of the material used in rail 24. In the case of more severe expansion, a truncated version 38 of rail 24 can be supported on a degradable pad 39 as shown in FIG. 14. Then, as in the first embodiment, pad 39 can be made of a material which deforms or disintegrates with time and moisture after slab 21 has hardened leaving slab 21 separated from, and bridging over, the expansive soil.

Figure 8:
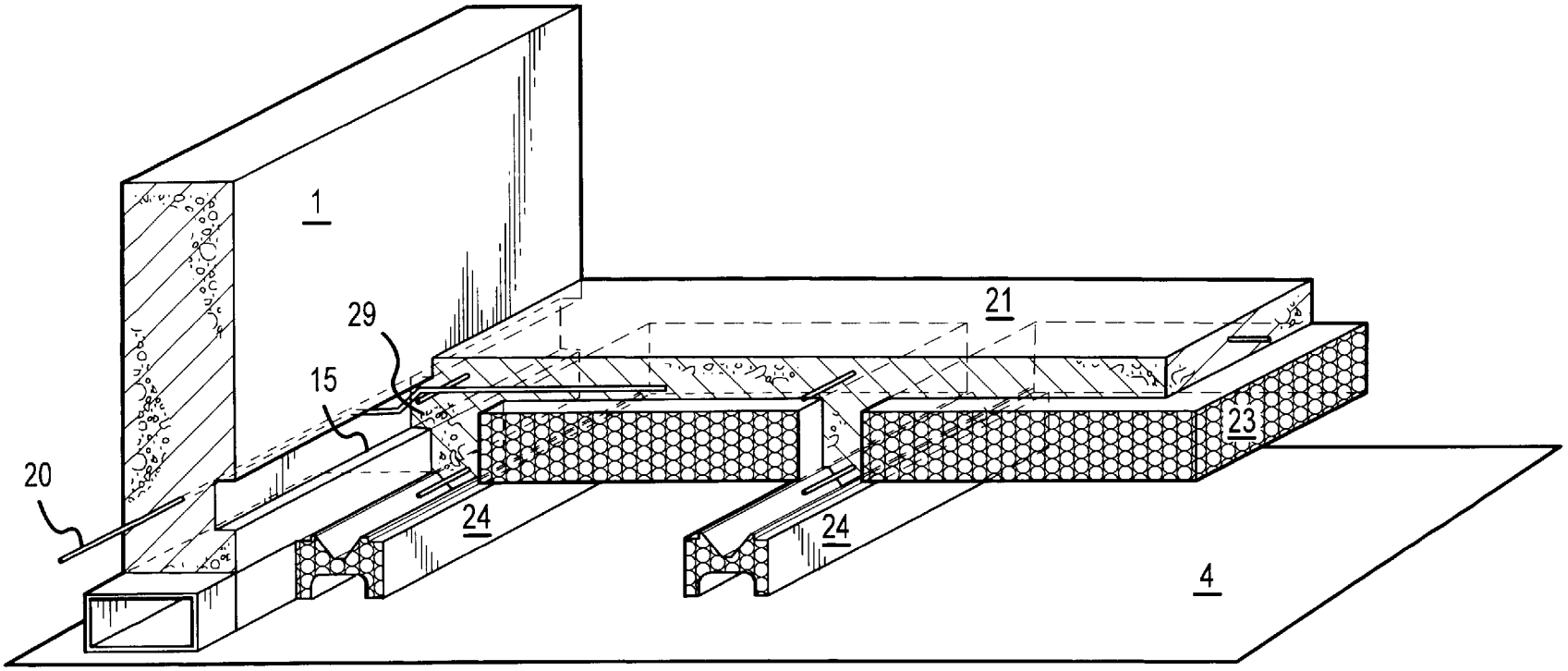
FIG. 8 shows a detailed perspective view of the second embodiment.

The second embodiment is lower in cost than the first embodiment because most of the material in the insulating forms is in the inexpensive rectangular panels 23. Only insulating rails 24 (or rails 38) have a complex shape. Slab 21 can be attached to the foundation walls by means similar to those described previously for the first embodiment. FIG. 8 provides a more detailed view of the second embodiment including a perspective view of the keying technique presented in the description of FIG. 6.

Figure 9:
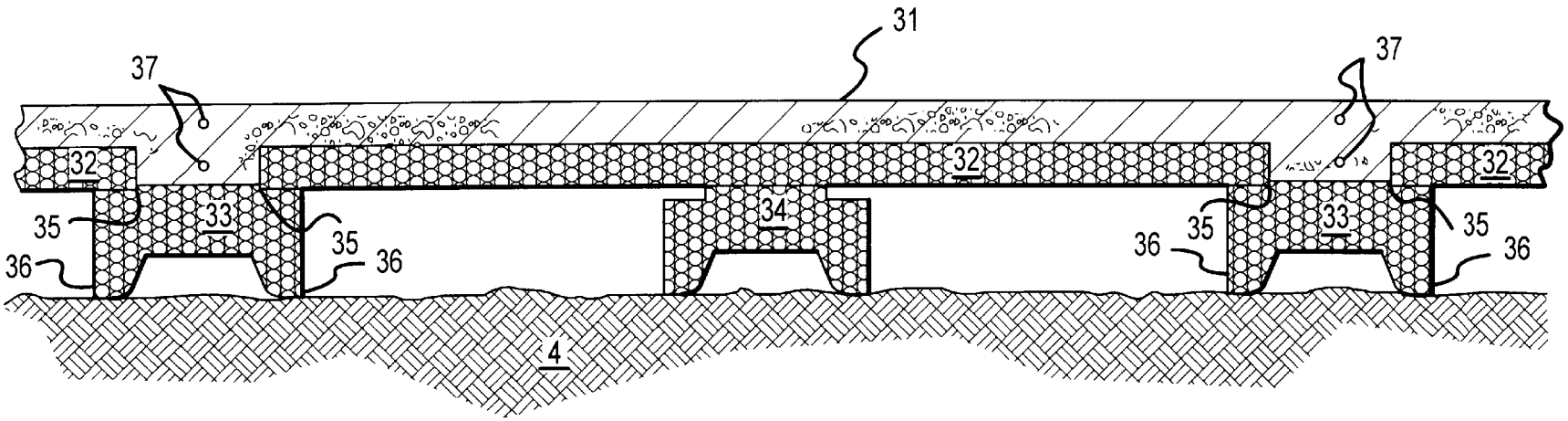
FIG. 9 shows a cross sectional view of a third embodiment of the slab assembly.
Figure 10:
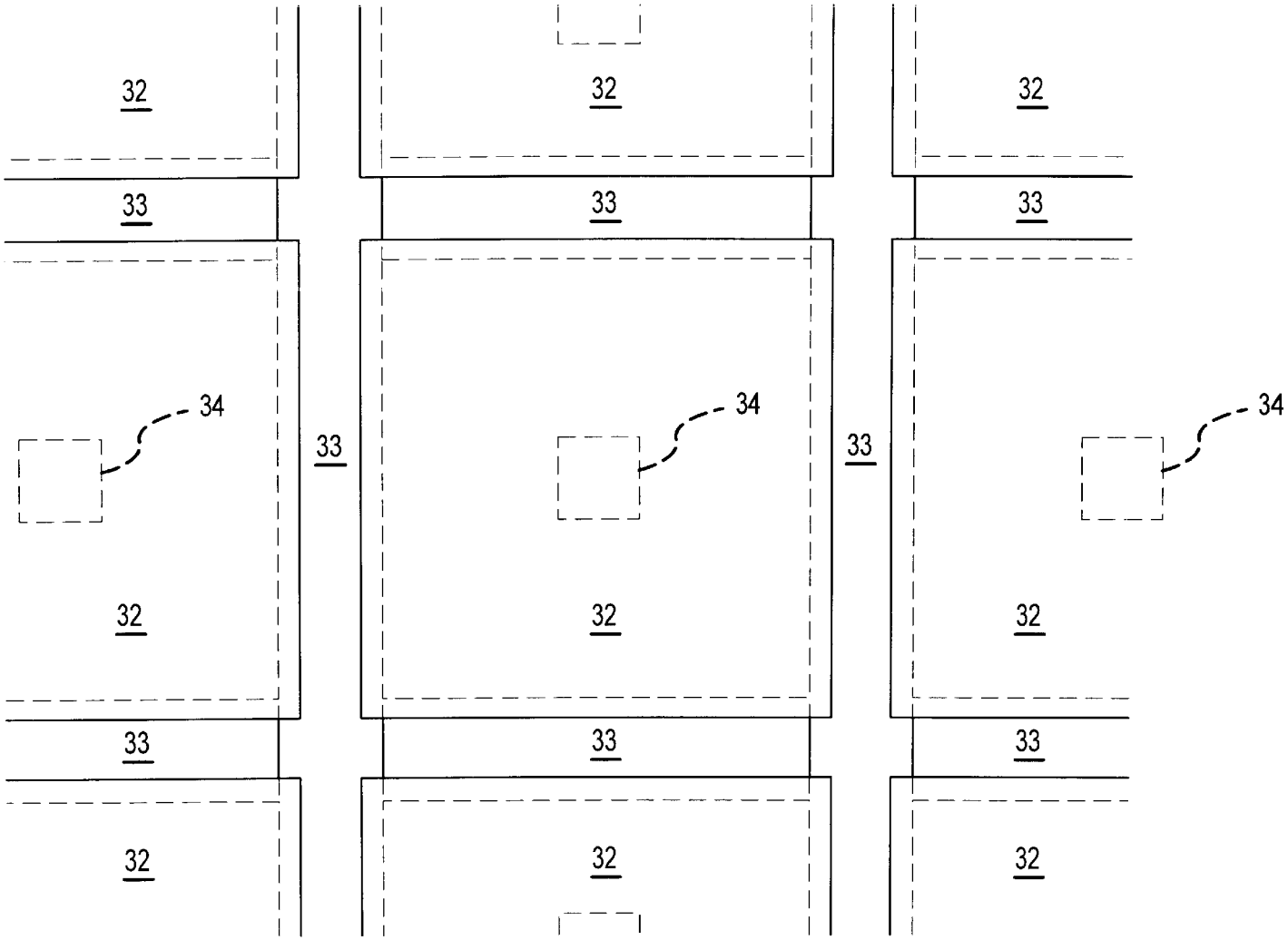
FIG. 10 shows a plan view of the third embodiment in a waffle slab assembly.
Figure 11:
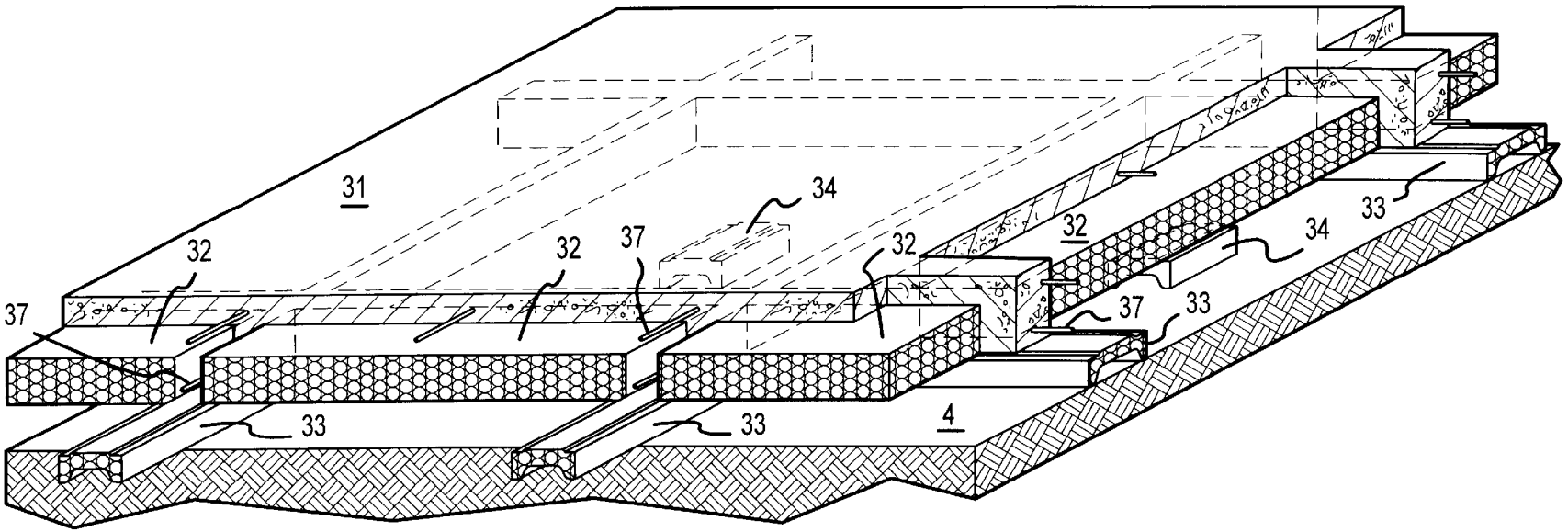
FIG. 11 shows a detailed perspective view of the third embodiment.
Figure 13:
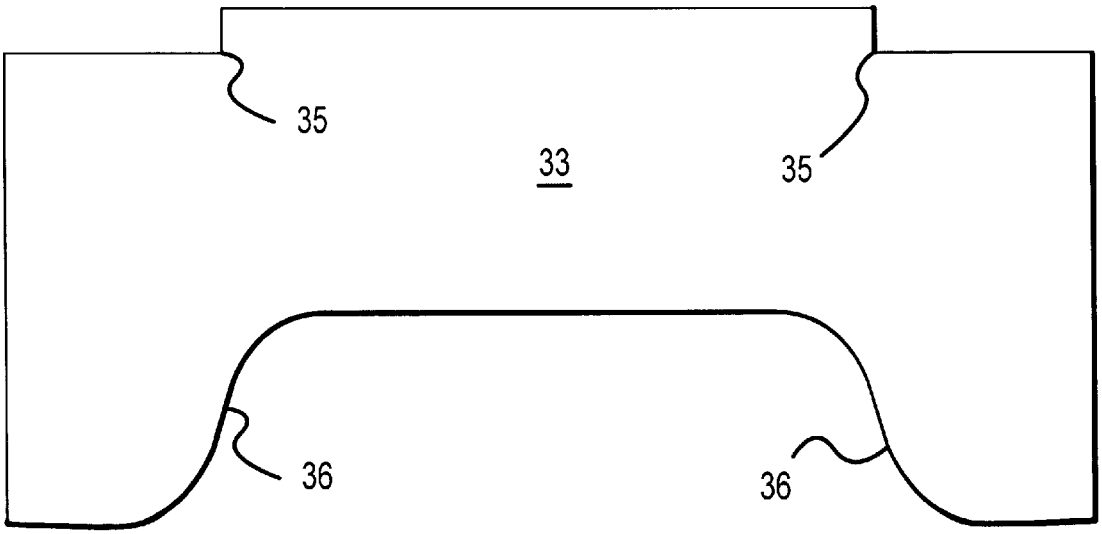
FIG. 13 shows a cross-sectional view of a rail used in the third embodiment.

FIG. 9 shows a cross-sectional view of a third embodiment of the invention, referred to as a waffle slab assembly. The waffle slab, or slab having a waffle pattern, is defined as a slab having thin areas surrounded by thicker ribs arranged in a grid pattern. This embodiment includes waffle slab 31 and insulating forms comprising waffle slab panels 32 and waffle slab rails 33. Simple rectangular panels 32 are supported by rails 33 which rest on excavation floor 4. Rails 33 have linear waffle slab indentations 35 for controlling placement and alignment of panels 32. Rails 33 also have narrow compliant waffle slab legs 36 which rest on relatively small contact areas of excavation floor 4. Center support members 34 rest on excavation floor 4 and provide additional support for insulating panels 32. As shown in the plan view of FIG. 10, rails 33 are arranged in a grid pattern supporting the edges of panels 32. The grid pattern of rails 33 produces a waffle pattern on the bottom of slab 31 (in which slab 31 is thicker over rails 33 and thinner over panels 32) when slab 31 is poured. Support members 34, which may be short sections of rails 33, provide support in the center of each panel 32. In this embodiment, waffle slab 31 is a floating slab supported after construction primarily by rails 33, and center support members 34, which rest on the soil of excavation floor 4. The compliant nature of legs 36 and the small contact area between legs 36 and excavation floor 4 permits the soil to expand without damaging waffle slab 31. FIG. 13 provides a more detailed view of the cross-section of rail 33. Panels 32 and rails 33 are preferably made of foamed polymer such as EPS. The design considerations previously described for rail 24 also apply to rail 33. FIG. 11 provides a detailed perspective view of the third embodiment.

All the previously described embodiments provide the ability to prevent or minimize two undesirable characteristics of concrete slabs. First, the movement of the slab due to expansive soils and, second, the heat loss through the slab.

The first and second embodiments provide rigid slabs which can be suspended from foundation walls with sufficient clearance from the excavation floor to allow the soil to expand and contract without movement of, or damage to, the slabs. The third embodiment provides a floating slab which is supported on a grid pattern of compliant rails. The grid pattern concentrates the load on small areas of the excavation floor and permits some expansion of the soil into the unloaded areas without movement of the slab.

The waffle slab construction provides sufficient strength for the entire slab to move without damage to itself. For example, if the expansion occurs in the center of the excavation floor, creating a convex or dome-like surface, the ribs act as cantilever beams supporting the edges of the slab. Conversely, if the expansion is around the edges of the excavation creating a concave or dished surface, the ribs act as beams bridging across the center of the excavation.

Where the soil is not significantly expansive, the forms of the first embodiment can be supported by non-degradable, minimally deformable support members or placed directly on the excavation floor. In the second and third embodiments, truncated rails, i.e., rails without compliant legs such as rail 38, can be placed directly on the excavation floor.

All three embodiments preferably use thermally insulating materials for the forms used in pouring the slabs. The forms remain in place after the slabs have hardened and provide thermal insulation to substantially reduce heat loss through the slabs. All three embodiments can also provide lateral support for the foundation walls.

The forms preferably are light in weight and can be made in large pieces to reduce handling and labor costs. Forms with complex cross sectional shapes can be easily fabricated from foamed polystyrene using automated tools. In the second and third embodiments, the large-area portions of the forms are inexpensive rectangular flat panels. By utilizing inexpensive forms which can be left in place after the slab is poured, the desirable features of the invention can be realized at a relatively low cost. While EPS foam was indicated as the preferred material for the forms, panels and rails, other materials may be preferred by those skilled in the art.

Although in the above embodiments support members and pads have been described as degradable, and legs and rails have been described as compliant, collapsible or crushable support members, pads, rails or legs can also be used to limit the forces applied to the slabs by expanding soil. Also, the members, pads, rails and legs can be made of various resilient materials known in the art, to provide compliance with repeated soil expansions and contractions without permanent deformation of these elements and without damage to, or movement of, the slabs. This compliance may be particularly valuable where local or seasonal moisture variations produce repeated differential expansions and contractions of the soil under the slab.

While the invention has been described above with respect to specific embodiments, it will be understood by those of ordinary skill in the art that various changes in form and details may be made therein without departing from the spirit and scope of the invention.

I claim:

1. A slab assembly, for use over expansive soil, comprising:

a form made of a thermally insulating material;

a pressure-deformable, substantially homogeneous and laterally discrete support member for said form, adapted to be located between said form and said soil; and a slab cast into said form by pouring a hardenable material into said form.

2. The slab assembly of claim 1 wherein said form is shaped to cast reinforcing ribs on said slab.

3. The slab assembly of claim 1 wherein said support member includes a material which disintegrates when exposed to moisture.

4. The slab assembly of claim 1 wherein said support member is made of a resilient material.

5. The slab assembly of claim 1 wherein said support member is adapted to provide separation between said expansive soil and said slab, said separation for preventing damage to slab due to soil expansion.

6. The slab assembly of claim 1 wherein said support member is capable of supporting said slab assembly during construction but is capable of deforming under pressure from expanding soil without damage to said slab when said slab has hardened.

7. The slab assembly of claim 2 wherein said ribs include steel reinforcing bars.

8. The slab assembly of claim 1 wherein said slab is adapted to be supported above said expansive soil by resting on a foundation wall after said slab has hardened.

9. The slab assembly of claim 1 further comprising a key on said slab and a keyway in a foundation wall, said key and keyway for supporting said slab above said expansive soil.

10. The slab assembly of claim 1 wherein said slab provides lateral support for a foundation wall.

11. The slab assembly of claim 1 wherein said hardenable material is concrete.

12. The slab assembly of claim 1 wherein said form is made of polystyrene.

13. A slab assembly, for use over expansive soil, comprising:

a form, comprising panels and pressure-deformable, substantially homogeneous rails, said panels supported by said rails; and a slab cast into said form by pouring a hardenable material into said form.

14. The slab assembly of claim 13 wherein said rails are arranged in rows.

15. The slab assembly of claim 13 wherein said rails are arranged in a grid pattern.

16. The slab assembly of claim 15 wherein said form produces a waffle pattern on said slab.

17. The slab assembly of claim 13 wherein said rails include narrow legs for resting on said soil.

18. The slab assembly of claim 13 wherein said rails include degradable pads for providing separation between said rails and said soil, said pads including a material which disintegrates when exposed to moisture.

19. The slab assembly of claim 13 wherein said rails are capable of supporting said slab assembly during construction but are capable of deforming under pressure from expanding soil without damage to said slab when said slab has hardened.

20. The slab assembly of claim 13 wherein said slab is a floating slab supported by said soil.

21. The slab assembly of claim 13 wherein said slab is supported above said expansive soil by a foundation wall after said slab has hardened.

22. The slab assembly of claim 13 further comprising a key on said slab and a keyway in a foundation wall, said key and keyway for supporting said slab above said expansive soil.

23. The slab assembly of claim 13 wherein said form is made of polystyrene.

24. A method of constructing a slab assembly over expansive soil, comprising:

placing a pressure-deformable, substantially homogeneous and laterally discrete support member on said soil;

placing a form made of a thermally insulating material, for casting a slab, on said support member;

pouring a hardenable material into said form;

allowing said hardenable material to solidify and become a slab; and allowing said form to remain in place between said slab and said soil.

25. The method of claim 24 wherein said form is shaped to cast reinforcing ribs on said slab.

26. The method of claim 24 wherein said support member includes a material which disintegrates when exposed to moisture.

27. The method of claim 24 wherein said support member is made of a resilient material.

28. The method of claim 24 wherein said support member is an integral part of said form.

29. The method of claim 24 wherein said slab is supported above said expansive soil by a foundation wall after said slab has hardened.

30. The method of claim 24 wherein said slab is supported above said expansive soil by a key on said slab and a keyway in said foundation wall.

31. A method of using a slab assembly over expansive soil, comprising:

providing a thermally insulating form, for casting a slab having reinforcing ribs;

providing a pressure-deformable, substantially homogeneous and laterally discrete support member for said form, said support member for supporting said form during casting of said slab;

placing said support member on said soil;

placing said form on said support member;

casting said slab by pouring concrete into said form;

allowing said concrete to harden into said slab; and allowing said form to remain permanently in place.

32. The method of claim 31 wherein said support member is capable of deforming under pressure from expanding soil without damage to said slab when said slab has hardened.

33. The method of claim 31 wherein said support member includes a material which disintegrates when exposed to moisture.

34. The method of claim 32 wherein said support member is made of a resilient material.

35. The method of claim 31 wherein said support member is an integral part of said form.

36. A slab assembly, for use over expansive soil, comprising:

a form, made of a thermally insulating material, said form having a shape for casting reinforcing ribs on a slab cast therein;

a pressure-deformable, substantially homogeneous and laterally discrete support member for said form, said support member for locating between said soil and said form and providing support for said form; and a slab, having reinforcing ribs, cast by pouring concrete into said form, said slab for bridging over said soil between foundation walls.

37. The slab assembly of claim 36 wherein said support member is capable of deforming under pressure from expanding soil without damage to said slab when said slab has hardened.

38. The slab assembly of claim 36 wherein said support member includes a material which disintegrates when exposed to moisture.

39. The slab assembly of claim 37 wherein said support member is made of a resilient material.

40. The slab assembly of claim 36 wherein said support member is an integral part of said form.

* * * * *